United States Patent [19]

Hess et al.

[11] 3,993,477

[45] Nov. 23, 1976

[54] SODIUM ADDITION TO ALUMINUM

[75] Inventors: Paul D. Hess, Lower Burrell; Robert E. Spear, Murrysville, both of Pa.

[73] Assignee: Aluminum Company of America, Pittsburgh, Pa.

[22] Filed: Oct. 21, 1974

[21] Appl. No.: 516,610

[52] U.S. Cl. ..... 75/148; 75/68 R; 75/147

[51] Int. Cl.[2] ..... C22C 1/02

[58] Field of Search ..... 75/148, 138, 68 R, 147

[56] References Cited

UNITED STATES PATENTS 3,634,075 1/1972 Hoff ..... 75/138

FOREIGN PATENTS OR APPLICATIONS 794,604 5/1958 United Kingdom

*Primary Examiner*—R. Dean

*Attorney, Agent, or Firm*—Jackson, Jackson and Chovanes

[57] ABSTRACT

Our invention relates to the feeding of sodium to aluminum containing silicon as an alloying element in hypoeutectic percentages by flowing the molten aluminum through a trough and feeding a tube which contains sodium within it into the aluminum in the trough, the tube being preferably fed in countercurrent direction with special mixing and a protective surface coating for the flowing molten aluminum. The invention appears primarily applicable to casting large masses of aluminum such as are used in the melts which produce aluminum ingots for sale to foundries.

2 Claims, 2 Drawing Figures

SODIUM ADDITION TO ALUMINUM

SUMMARY OF THE INVENTION

Our invention relates to the use of an extended moving tube to surround and feed enclosed sodium to molten aluminim containing silicon as an alloying element in hypoeutectic percentages, which molten aluminum is flowing from a melt or other source.

Our invention primarily is intended for treating large amounts of molten aluminum such as are used in producing aluminum ingots for sale to foundries.

PRIOR ART

It has been the practice to add sodium to various aluminum alloys containing silicon, to improve the mechanical properties of the alloys, including especially their ductility and tensile strength. This is especially in the case where there is an aluminum alloy containing from 5 to 13% of silicon.

However, this has a tendency in various ways to introduce gas into the resultant cast aluminum. For example, since sodium often is protected by paraffin or some other hydrocarbon from deterioration beforehand, substantial gas results from the residual paraffin added to the aluminum with the sodium.

The sodium may be protected from moisture and air by canning it under a vacuum and inserting the thin-walled aluminum cans or the like, into the bath of liquid aluminum containing varying amounts of silicon. (British patent to Cherry, Foundry Services, Limited, No. 794,604 of 1958)

However, as this is practiced it has important drawbacks, as will be seen.

One way in which various alloying or grain refining constituents have been proposed to be added to aluminum and other molten metals has been to take either the constituents per se, or an alloy of which they form a part, and form a strip or wire from the material in question and add this wire continuously, this being done in Kawecki Berylco Industries, Inc., British Pat. No. 1,244,082, published 1971, which alloys aluminum with 5% titanium and 1% boron and feeds a wire of the alloy countercurrent into molten aluminum flowing in a trough.

DESCRIPTION OF THE INVENTION

The present invention is of particular importance in supplying sodium to aluminum ingots to be later supplied to foundries. The reason for adding the soidum to the aluminum-silicon alloy is to change from a needle or plate-like microstructural particle to a more spherodized structure, with consequent improvement in properties such as ductility and tensile strength. In the casting of ingot for remelting in the foundry the aluminum may be a reverberatory furnace charge of say 50,000 pounds. If the canning technique is used, substantially all the sodium is likely to have gone up the stack within a few hours after it is fed, with consequent deterioration of the structure of the alloy.

The present invention provides a special means of introducing the sodium which when properly carried out will result in an accurate, sufficient quantity of sodium in the aluminum as originally cast, with a minimum of wastage of sodium.

In the preferred form of the invention, a tube of aluminum is preheated and filled with molten sodium, the filling being by the technique of sucking of sodium into a preheated aluminum tube until the sodium appears in a trap of the tube. The trap itself is also specifically first preheated to drive off any moisture which might otherwise react with the sodium.

The tube will preferably be annealed seamless tubing of substantially pure aluminum, with a wall thickness substantially greater than usually found in standard tubing of the size used. For example more particularly, a highly convenient tubing which is preferable to use is ⅜ inch outside diameter tubing, but whereas it is common in such tubing to have a wall thickness of 0.035 inches, the wall thickness in the present case should preferably be substantially greater than that, — preferably a wall thickness on the order of a twentieth of an inch or greater and more specifically on the order of one sixteenth of an inch, insofar as we now can best judge.

After filling, the tubing is crimped closed at both ends, by pliers for example, bringing opposite sides down against each other, preferably in the form of opposed flat surfaces at the point of contact.

The preheating temperature for the tubing is significant. The real concern is that the whole coil is hot enough so that the sodium does not freeze before complete filling. If it is too cold, the sodium will freeze up.

One question was whether the liquid sodium would react with or dissolve the tubing. No significant reaction or dissolution was noted on testing.

Another problem was that of hermetically sealing the tubing against moisture and oxidation, or any other tendency toward diffusion at either end of the tube, especially in view of the fact that sodium burns in air. This might especially come to the fore when it is again crimped after initial use. In the experimental program no moisture pickup was noted even after storage of the tubing over a period of a year, and it is believed the method will be entirely satisfactory in this respect.

Please note that if the sodium floats, it will burn, resulting in low recovery.

The inventors were also concerned that possibly during use in the sodium might take fire, causing the tube to burn back like a sparkler. Tests proved that this was needless fear.

After the tube has been filled with the sodium and its ends crimped, it is fed at a controlled rate into molten aluminum flowing down in a trough, the tube preferably being fed in a direction countercurrent to the direction of flow in the trough and entering near the point at which aluminum from the original melt or other source enters the trough.

At the point where the aluminum tubing containing the sodium is fed into the trough, the aluminum in the trough should preferably be deeper than elsewhere, to permit special depth of penetration. This extra depth may and preferably will be secured by establishing a dam below that, which may best have an orifice for the outflow of the aluminum.

At that point there should preferably also be provided a layer of salt on top of the aluminum, for example a eutectic mixture of sodium and potassium chlorides, — to shield the surface of the aluminum and minimize any loss of sodium.

Also, there should preferably be provided, at or below the point of introduction of the tubing, a positive additional method of mixing to insure the greatest practical extent of uniformity of distribution of the sodium in different parts of the aluminum alloy. This may be done for example by providing a sump with inert gas such as argon bubbling up for stirring purposes, a static mixer, or some other means for mixing.

More specifically, in the case of the sump, the inert gas should preferably come in at or near the bottom of a basin which may best be on the order of five to ten times as deep as the metal is when it flows unimpeded in the trough, and this form is shown in the drawings.

Another specific means is to use for mixing the setup shown in Hess, Brodyke and Jarrett, U.S. Pat. Nos. 3,039,864 and 3,172,757, where it is specifically used for metal treatment. By static mixer, which has already been mentioned as another alternative, is meant the known type of mixing device in which what is flowing and is desired to be better mixed is brought into a confined passage in which mixing is promoted by the special construction of the passage, as where there is a convoluted interior involving helical projections or the like.

A particular advantage of this method with the continuous insertion of an extended length of tubing is that sodium has a density lower than that of molten aluminum and the molten sodium-filled tubing is immersed below the surface of the molten aluminum so that the sodium is assured of immersion in the interior of the molten aluminum as the aluminum tubing melts.

In the drawings we have sought to disclose one particular highly suitable exemplary method of filling the tube and one particular highly suitable exemplary method of feeding the molten sodium into the aluminum, the particular embodiments being chosen from various standpoints.

In filling the liquid sodium into the tube, metallic sodium is suitably melted in a steel crucible in a resistance furnace under an argon atmosphere and the temperature is preferably controlled between 200° and 230° F. Meanwhile, a ⅜ inch diameter tube of aluminum, for example, is preheated preferably to approximately 300° to 400° F. The molten sodium is skimmed to remove surface oxide and one end of the tube is inserted under the molten sodium, and the other end is connected to a trap, which already has been preheated to drive off moisture. The trap in turn is connected to a vacuum pump.

The purpose of the trap is to prevent molten sodium from being drawn into the vacuum pump and to permit observation to determine when the tubing was filled with sodium. When the molten sodium starts to enter the trap, both ends of the tubing are immediately crimped with pliers to stop the flow and seal the ends of the tubing to prevent reaction from the sodium with moisture and oxygen.

Figure 1:
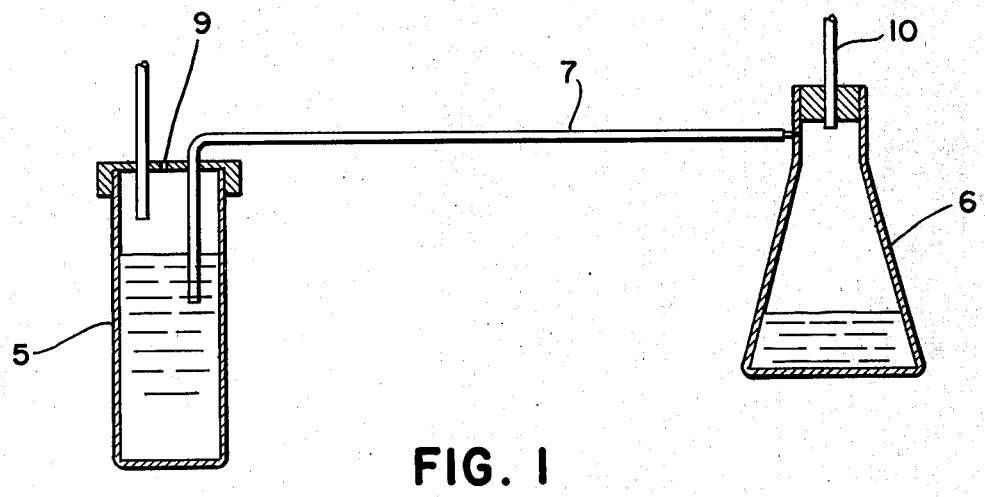
FIG. 1 is a diagrammatic section of a device for sucking sodium through a tube.

In FIG. 1 we have shown liquid sodium melted in a crucible 5, which is charged into an aluminum tube 7 connected to a trap 6, the trap being connected to a vacuum pump (not shown) by tubing 10. The crucible has a vent 9.

Figure 2:
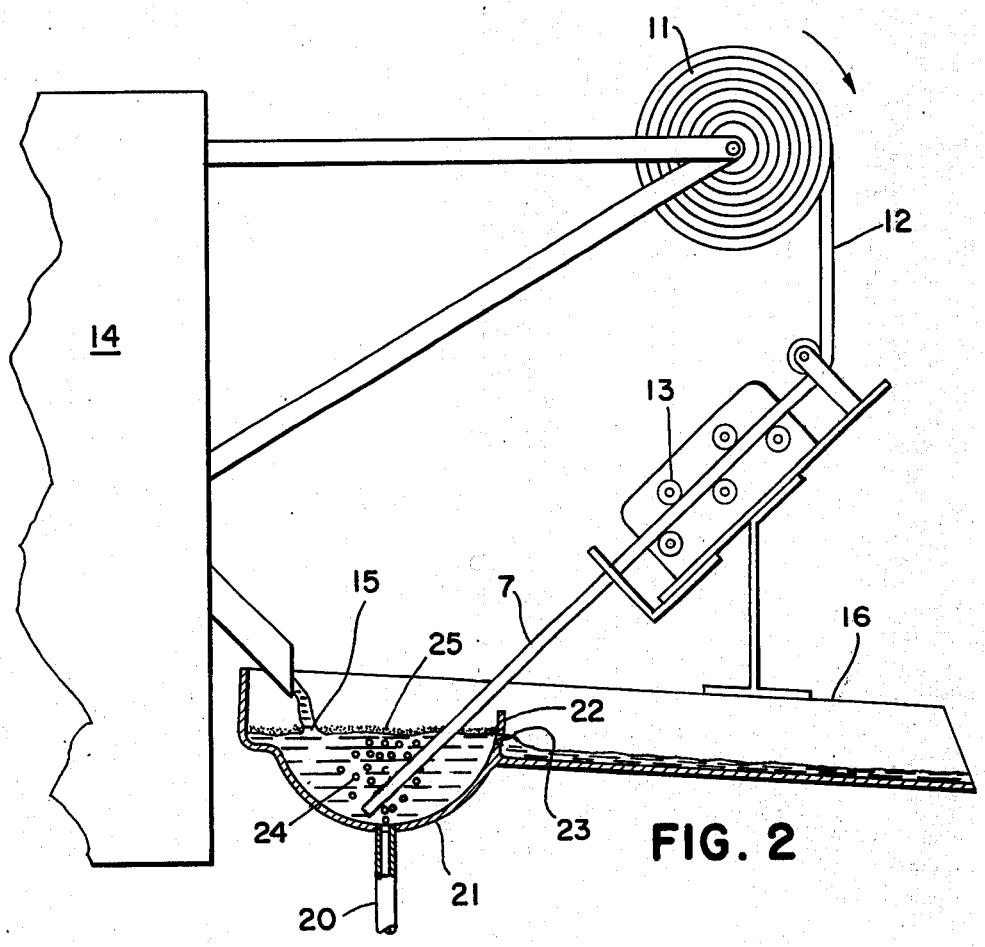
FIG. 2 is a diagrammatic view partly in section of an aluminum tube filled with sodium inserted into a flowing stream of aluminum.

As shown in FIG. 2, a reverberatory furnace 14 is discharging aluminum alloy 15 containing a minor amount of silicon such as 7% into a trough or launder setup 16 during casting. A dam 22 with an orifice 23 is placed in the trough to control the metal flow rate and also to provide a region in the trough with sufficient metal depth in which to feed the tubing. The tubing 7 is fed countercurrent to the flow of the aluminum alloy.

More specifically, the aluminum tubing on roll 11 is drawn in downward path 12 and gradually fed by a proportional feeder 13 countercurrent to the liquid aluminum flow through the trough setup 16, coming into the trough setup near the place where the aluminum 15 goes into that trough setup.

Around the downstream of the place where the sodium-filled aluminum tube penetrates the flowing molten aluminum, a sump 21 extends downward and at its bottom the tube or pipe 20 enters, to enable an inert gas such as argon which is carried by that tube to bubble up from the bottom of the sump through the aluminum as shown at 24, and thus promote mixing of the sodium throughout the flowing aluminum to get substantial uniformity of distribution. As already indicated, some other form of positive special mixing means could be used instead.

It has been found that better results from the standpoint of modification of crystalline structure of the alloy and minimizing fuming and burning can be obtained where a molten salt mixture, such as a eutectic mixture of sodium chloride and potassium chloride (45% NaCl and 55% KCl) is placed on the surface of the metal in the trough at the point of entry of the tube. This was determined in the tests, Example 4 having involved such a procudure, as will be seen. Layer 25 in FIG. 2 is such a layer of molten salt, floating on the molten aluminum in an area including the point where the tube enters the molten aluminum, and held in that area by the dam, together with the fact that the orifice through which the aluminum passes through the dam is below the layer of salt.

If and when the pouring of the ingots stops, any sodium-filled aluminum tubing left over can simply be crimped closed once again, and will then be ready for storage or further use.

The method of operation of the specific preferred embodiment of the invention will be evident from the foregoing. The sodium-filled tube with both ends crimped closed is prepared as already stated and then put on a roll 11. It is drawn from that roll by proportional feeder 13 and its end is continuously thrust into the interior of the aluminum alloy stream at a rate designed to give accurate and sufficient proportion of sodium in the aluminum alloy stream under the circumstances, as the end of the aluminum alloy tubing melts off in the interior of the molten aluminum releasing the sodium within it there. The molten aluminum alloy 15 from reverberatory furnace 14 comes into the trough setup in its upstream area where it is dammed up by dam 22 and inert gas bubbles up from the bottom of a sump to provide positive additional mixing. On top of the molten aluminum alloy is a layer of salt which is above the orifice 23 which permits the molten aluminum to flow out through the dam, the layer of salt thus remaining in place on top. After it passes through the dam by way of the orifice, the molten aluminum alloy with its addition of sodium flows on down trough 16 and out to be cast as an ingot, for example.

In the tests as actually carried out, an experimental 100 foot length of aluminum tube was filled with sodium. Sodium melting conditions and tube preheat were as already stated. The tube had a wall thickness of 0.035 inch and it was ⅜ inch O.D. It was in the annealed condition. Although it would have been preferable to have substantially pure aluminum tubing, the tube contained 1.4% magnesium. It was welded on the longitudinal seam, although it would be preferable to use seamless tubing. After filling the tubing was crimped at both ends by pliers.

The molten aluminum alloy into which the tubing was thrust was an alloy containing approximately 7% silicon and 0.3% magnesium.

A dam with an orifice was used and the tubing was fed in a countercurrent direction into the trough, which in this case had a bottom sloping up continuously at the same slope throughout. No sump and no special additional method of mixing, such as argon bubbling up from the bottom were employed.

EXAMPLE 1

Aluminum tubing was fed into the molten aluminum containing silicon, without any cover or shield. The tubing melted immediately upon entry. Burning and fuming occurred at the point of entry but sodium recovery was good. The flow rate was 8712 pounds per hour and the sodium filled tube was fed at a rate of 10 inches per minute.

| | Sodium Content |
|---|---|
| Furnace metal | 0.0001% |
| Trough metal after 5 minutes of feeding | 0.002% |
| Trough metal after 10 minutes of feeding | 0.002% |
| Trough metal after 15 minutes of feeding | 0.003% |
| Trough metal after 20 minutes of feeding | 0.007% |

EXAMPLE 2

A eutectic mixture of sodium chloride and potassium chloride containing 45% sodium chloride and 55% potassium chloride was placed on the surface of the molten metal in the trough at the point of entry of the tubing in an attempt to decrease the burning and fuming. The salt mixture formed a crust. Considerable burning and fuming still occurred. The test was terminated after 20 minutes due to the loss of the dam in the trough. Estimated metal flow rate was approximately 7000 pounds per hour and feed rate of the sodium-filled tube was 10 inches per minute.

| | Sodium Content |
|---|---|
| Furnace metal | 0.0004% |
| Trough metal after 5 minutes of feeding | 0.003% |
| Trough metal after 10 minutes of feeding | 0.004% |
| Trough metal after 15 minutes of feeding | 0.003% |

EXAMPLE 3

A float with a hole in the middle was floated on the top of the metal in the trough and the tubing fed through the hole in an attempt to reduce burning. The hole clogged with reaction product after 3 minutes and did not permit further feeding. Then the float was removed and the tube was fed directly into the metal throughout the remainder to the test. Metal flow rate was 6495 pounds per hour and sodium-filled tubing feed rate was 10 inches per minute.

| | Sodium Content |
|---|---|
| Furnace metal | 0.0001% |

-continued

| | Sodium Content |
|---|---|
| Trough metal after 5 minutes of feeding | 0.001% |
| Trough metal after 10 minutes of feeding | 0.001% |
| Trough metal after 15 minutes of feeding | 0.002% |
| Trough metal after 20 minutes of feeding | 0.001% |
| Trough metal after 25 minutes of feeding | 0.002% |
| Trough metal after 30 minutes of feeding | 0.001% |

EXAMPLE 4

In this test the molten eutectic mixture of sodium chloride and potassium chloride was placed on the surface of the metal in the trough at the point of entry of the sodium-filled tube. Burning and fuming still occurred but it was somewhat reduced over that when no cover was used. Metal flow rate was 7127 pounds per hour. Sodium-filled tubing feed rate 20 inches per minute.

| | Sodium Content |
|---|---|
| Furnace metal | 0.0001% |
| Trough metal after 5 minutes of feeding | 0.004% |
| Trough metal after 10 minutes of feeding | 0.004% |
| Trough metal after 15 minutes of feeding | 0.004% |
| Trough metal after 20 minutes of feeding | 0.003% |

These tests show that the continuous feeding of the sodium-filled aluminum tubing into a metal flowing in a trough during casting results in substantially uniform feeding of sodium.

In view of our invention and disclosure, variations and modifications to meet individual whim or particular need will doubtless become evident to others skilled in the art to obtain all or part of the benefits of our invention without copying the method and apparatus shown, and we, therefore, claim all such insofar as they fall within the reasonable spirit and scope of our claims.

Having thus described our invention what we claim as new and desire to secure by Letters Patent is:

1. The method of adding sodium to molten aluminum alloy containing silicon as an alloying element in hypoeutectic percentages, which comprises (a) taking extended tubing predominantly of aluminum, (b) preheating it to a temperature in the range from 300° F. through 400° F., (c) filling it with molten sodium, (d) crimping it closed at the ends, (e) thereafter causing the previously mentioned molten aluminum alloy to move in a stream, there being a sump with inert gas bubbling up from the bottom in the stream and a dam with an orifice in it in the stream creating higher level of aluminum for a certain distance above it and there being a layer of molten salt material on the surface of the stream above the dam, (f) taking the previously mentioned tubing enclosing the sodium and (g) progressively and continuously at a controlled rate inserting one end of the tubing into and beneath the surface of the stream in a direction countercurrent to the flow of the stream and at a point within the higher level of aluminum from the dam and under the layer of molten salt material and at or upstream of the sump, while the other end of the tubing is outside the stream.

2. The method of claim 1 in which the sump is beneath the higher level of aluminum created for a certain distance above the dam.

* * * * *

PO-1050
(5/69)

UNITED STATES PATENT OFFICE
CERTIFICATE OF CORRECTION

Patent No. 3,993,477 Dated November 23, 1976

Inventor(s) Paul D. Hess and Robert E. Spear

It is certified that error appears in the above-identified patent and that said Letters Patent are hereby corrected as shown below:

Column 2, line 41, after "use" delete "in".

Column 4, line 9, change "the" (first occurrence) to -- and -- .

Column 4, line 28, change "procudure" to -- procedure -- .

Column 5, line 63, change "to" to -- of -- .

Column 6, line 54, after "creating" insert -- a -- .

Signed and Sealed this

First Day of March 1977

[SEAL]

*Attest:*

RUTH C. MASON
*Attesting Officer*

C. MARSHALL DANN
*Commissioner of Patents and Trademarks*